US008421681B2

(12) United States Patent
Chiu et al.

(10) Patent No.: US 8,421,681 B2
(45) Date of Patent: Apr. 16, 2013

(54) MULTI-BAND ANTENNA

(75) Inventors: Chieh-Ping Chiu, Tianwei (TW); Feng-Jen Weng, Kuei Shan Hsiang (TW); Hsiao-Wei Wu, Zhongli (TW); I-Ping Yen, Yonghe (TW)

(73) Assignee: Quanta Computer Inc., Tao Yuan Shien (TW)

( * ) Notice: Subject to any disclaimer, the term of this patent is extended or adjusted under 35 U.S.C. 154(b) by 354 days.

(21) Appl. No.: 12/872,038

(22) Filed: Aug. 31, 2010

(65) Prior Publication Data

US 2011/0254738 A1 Oct. 20, 2011

(30) Foreign Application Priority Data

Apr. 20, 2010 (TW) ..... 99112352 A

(51) Int. Cl.

| | |
|---|---|
| ***H01Q 1/38*** | (2006.01) |
| ***H01Q 5/00*** | (2006.01) |
| ***H01Q 9/04*** | (2006.01) |
| ***H01Q 1/48*** | (2006.01) |

(52) U.S. Cl.
USPC ..... 343/700 MS; 343/846

(58) Field of Classification Search ..... 315/700 MS, 315/846
See application file for complete search history.

(56) References Cited

U.S. PATENT DOCUMENTS

| | | | | |
|---|---|---|---|---|
| 7,034,769 | B2 * | 4/2006 | Surducan et al. | 343/793 |
| 7,119,748 | B2 * | 10/2006 | Autti | 343/702 |
| 7,161,541 | B2 * | 1/2007 | Chen | 343/700 MS |
| 7,612,726 | B2 * | 11/2009 | Qi et al. | 343/702 |
| 7,728,785 | B2 * | 6/2010 | Ozden | 343/866 |
| 7,768,460 | B2 * | 8/2010 | Yang et al. | 343/700 MS |
| 8,223,083 | B2 * | 7/2012 | Wong et al. | 343/770 |
| 2004/0056805 | A1 * | 3/2004 | Chen | 343/700 MS |
| 2005/0068243 | A1 * | 3/2005 | Chen | 343/790 |

* cited by examiner

*Primary Examiner* — Shawki Ismail
*Assistant Examiner* — Dylan White
(74) *Attorney, Agent, or Firm* — Nixon & Vanderhye P.C.

(57) ABSTRACT

An antenna includes a grounding element, a connecting element, and first and second radiator elements. The connecting element includes an elongated first connecting section, and a second connecting section connecting the first connecting section to the grounding element. The first radiator element includes a first radiator section extending substantially perpendicular from one side of the first connecting section, and second and third radiator sections extending substantially perpendicular from one side of the first radiator section. The second radiator element includes a first radiator portion extending substantially perpendicular from the one side of the first connecting section, and second and third radiator portions extending substantially perpendicular from one side of the first radiator portion and extending in an opposite direction relative to the second and third radiator sections.

18 Claims, 8 Drawing Sheets

MULTI-BAND ANTENNA

CROSS-REFERENCE TO RELATED APPLICATION

This application claims priority of Taiwanese Application No. 099112352, filed on Apr. 20, 2010, the entire content of which is hereby incorporated by reference.

BACKGROUND OF THE INVENTION

1. Field of the Invention

The present invention relates to a multi-band antenna, more particularly to an antenna with peak gain suppression and a relatively high radiation efficiency.

2. Description of the Related Art

Referring to FIG. 1, a conventional dual resonance inverted-F antenna 9 includes a linear first radiator portion 92, a linear second radiator portion 93, a grounding portion 95, and a step-like connecting portion 94 connecting electrically the first and second radiator portions 92, 93 to the grounding portion 95. The first radiator portion 92 and the connecting portion 94 constitute a first radiator arm resonant in a first frequency band. The second radiator portion 93 and the connecting portion 94 constitute a second radiator arm resonant in a second frequency band that is lower than the first frequency band.

The antenna 9 is applicable to portable devices, such as portable computers, and is adapted for operation in Wireless Local Area Networks (WLAN) and Worldwide Interoperability for Microwave Access (WIMAX) networks. To reduce interference from the antenna 9, gain of the antenna 9 is generally limited by decreasing the height, increasing the Voltage Standing Wave Ratio (VSWR), or shifting the operational frequency bands. However, the above-mentioned schemes compromise radiation efficiency of the antenna 9.

SUMMARY OF THE INVENTION

Therefore, an object of the present invention is to provide an antenna with peak gain suppression and a relatively high radiation efficiency.

Accordingly, an antenna of the present invention is adapted for disposing on a substrate, and includes a grounding element, a connecting element, and first and second radiator elements.

The connecting element includes an elongated first connecting section, and a second connecting section connecting the first connecting section to the grounding element. The first radiator element includes a first radiator section extending substantially perpendicular from one side of the first connecting section, and second and third radiator sections extending substantially perpendicular from one side of the first radiator section.

The second radiator element includes a first radiator portion extending substantially perpendicular from the one side of the first connecting section, and second and third radiator portions extending substantially perpendicular from one side of the first radiator portion and extending in an opposite direction relative to the second and third radiator sections.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
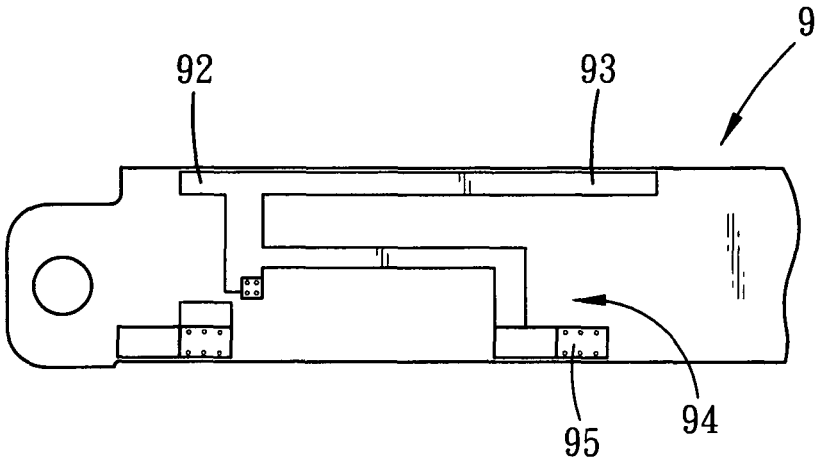
FIG. 1 PRIOR ART
FIG. 1 is a schematic diagram illustrating a conventional dual resonance inverted-F antenna.

Before the present invention is described in greater detail, it should be noted that like elements are denoted by the same reference numerals throughout the disclosure.

Figure 2:
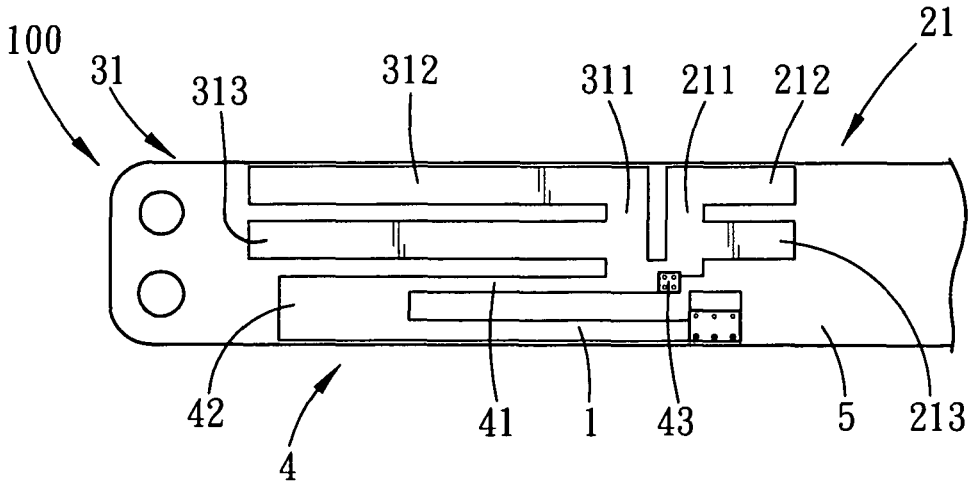
FIG. 2 is a schematic diagram illustrating the first preferred embodiment of a multi-band antenna according to the present invention.

Referring to FIG. 2, the first preferred embodiment of a multi-band antenna 100 according to the present invention is adapted for disposing on a substrate 5, and includes an elongated grounding element 1, a connecting element 4, and first and second radiator elements 21, 31.

The grounding element 1 has opposite first and second ends. The connecting element 4 is substantially L-shaped, and includes an elongated first connecting section 41, and a second connecting section 42 that extends substantially perpendicular from the first end of the grounding element 1 and that connects the first connecting section 41 to the grounding element 1. The first connecting section 41 extends from the second connecting section 42 in a direction from the first end to the second end of the grounding element 1, and is substantially parallel to the grounding element 1.

The first connecting section 41 has one end distal from the second connecting section 42 and serving as a feed-in point 43 for feeding of signals. The first radiator element 21 is resonant in a first frequency band, and includes a first radiator section 211 extending substantially perpendicular from one side of the first connecting section 41, and second and third radiator sections 212, 213 extending substantially perpendicular from one side of the first radiator section 211.

The second radiator element 31 is resonant in a second frequency band lower than the first frequency band, and includes a first radiator portion 311 extending substantially perpendicular from said one side of the first connecting section 41, and second and third radiator portions 312, 313 extending substantially perpendicular from one side of the first radiator portion 311 and extending in an opposite direction relative to the second and third radiator sections 212, 213.

In the present embodiment, the first radiator section 211 and the first radiator portion 311 have respective distal ends distal from the first connecting section 41, and the second radiator section 212 and the second radiator portion 312 extend from the distal ends of the first radiator section 211 and the first radiator portion 311, respectively. The third radiator section 213 and the third radiator portion 313 are disposed proximate to the first connecting section 41 relative to the second radiator section 212 and the second radiator portion 312, respectively.

Accordingly, in this embodiment, the first radiator element 21 exhibits an F-shape and the second radiator element 31 exhibits a mirror F-shape relative to the first radiator element 21.

The multi-band antenna 100 of the first preferred embodiment has dimensions as follows: the second radiator section 212 has a length of 1.6 cm; the second radiator portion 312 has a length of 4.7 cm; the second connecting section 42 has a width of 0.8 cm; each of the second and third radiator sections 212, 312 and the second and third radiator portions 312, 313 has a width of 0.5 cm; the third radiator section 213 is spaced apart from the second radiator section 212 by a distance of 0.2 cm; the third radiator portion 313 is spaced apart from the second radiator portion 312 by a distance of 0.2 cm; the first connecting section 41 is spaced apart from the third radiator portion 313 by a distance of 0.2 cm; the grounding element 1 is spaced apart from the first connecting section 91 by a distance of 0.35 cm; each of the first radiator section 211 and the first radiator portion 311 has a length of 0.5 cm; and the first radiator section 211 is spaced apart from the first radiator portion 311 by a distance of 0.25 cm.

Figure 3:
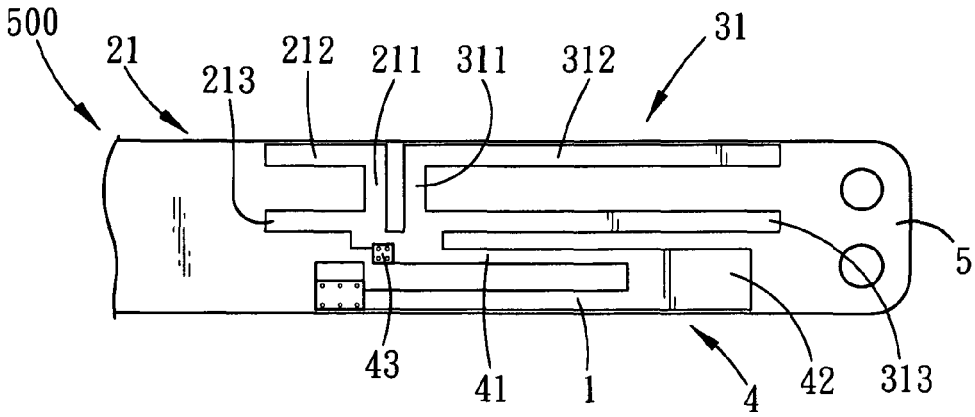
FIGS. 3 to 5 are schematic diagrams illustrating the second, third, and fourth preferred embodiments of a multi-band antenna according to the present invention, respectively.

Referring to FIG. 3, the second preferred embodiment of a multi-band antenna 500 according to the present invention has a mirror configuration of the multi-band antenna 100 of the first preferred embodiment relative to an axis.

Those skilled in the art may readily appreciate that connection between the second connecting section 42 and the grounding element 1 and length of the first connecting section 41 may be adjusted depending on requirements.

Figure 4:
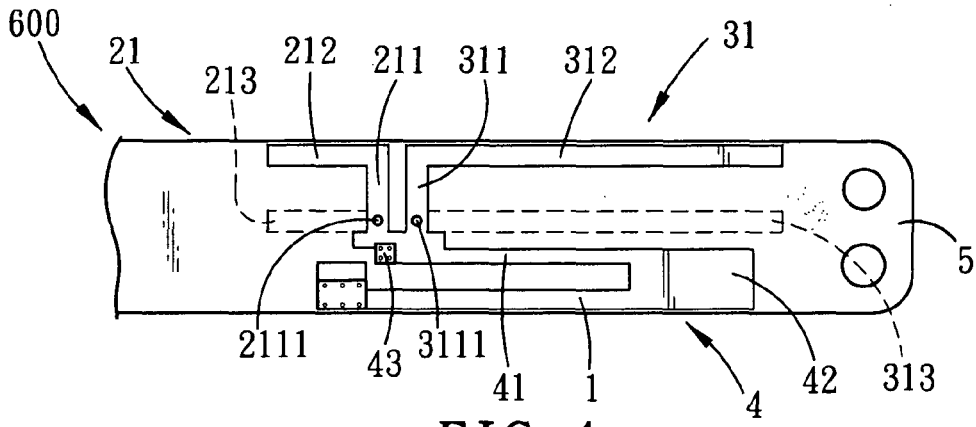

Referring to FIG. 4, the third preferred embodiment of a multi-band antenna 600 according to the present invention is similar to the multi-band antenna 500 of the second preferred embodiment. However, in the third preferred embodiment, the third radiator section 213 and the third radiator portion 313 are disposed on another surface of the substrate 5 opposite to that on which the other elements are disposed, and are connected electrically and respectively to the first radiator section 211 and the first radiator portion 311 via respective via holes 2111, 3111.

Figure 5:
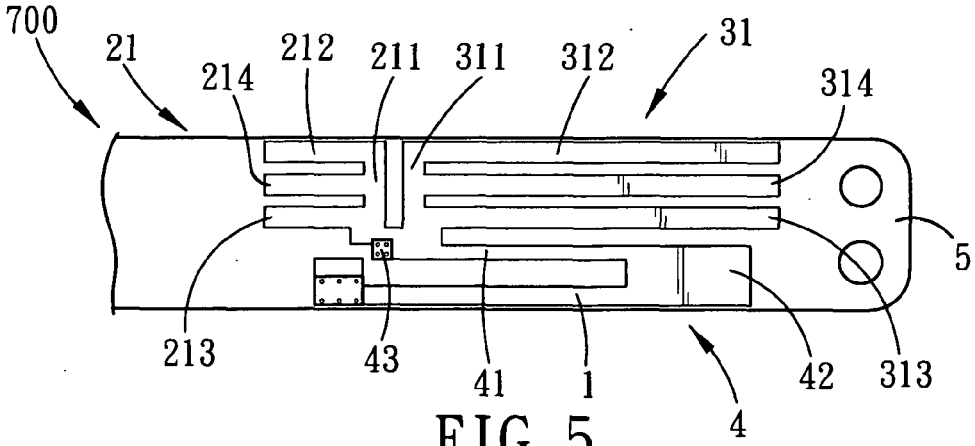

Referring to FIG. 5, the fourth preferred embodiment of a multi-band antenna 700 according to the present invention is similar to the multi-band antenna 500 of the second preferred embodiment. However, the multi-band antenna 700 further includes a fourth radiator section 214 and a fourth radiator portion 314 similar to the third radiator section 213 and the third radiator portion 313, and extending perpendicular from said one side of the first radiator section 211 and said one side of the first radiator portion 311 in opposite directions, respectively.

Figure 6:
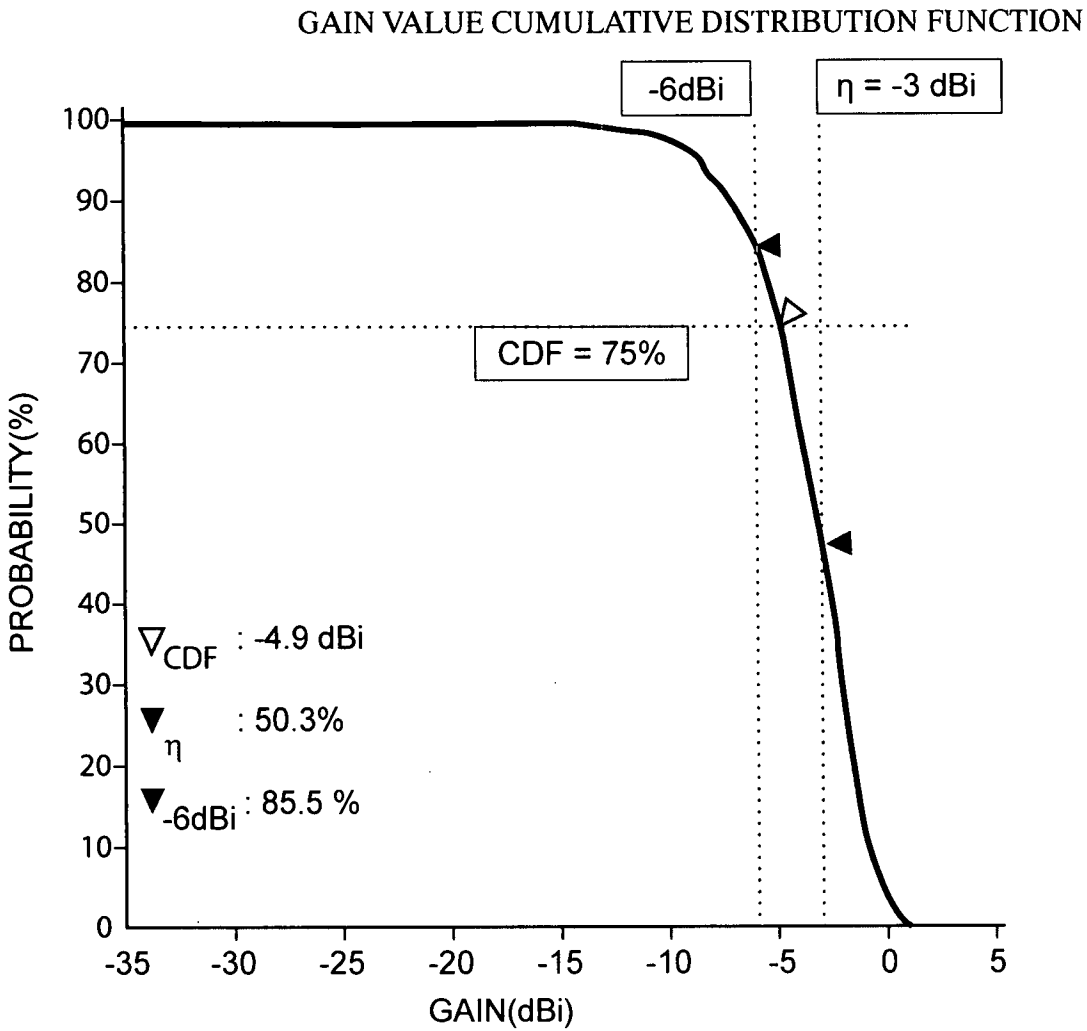
FIG. 6 PRIOR ART
FIG. 6 is a plot illustrating the cumulative distribution of gain of the conventional dual resonance inverted-F antenna operating at 2600 MHz.
Figure 7:
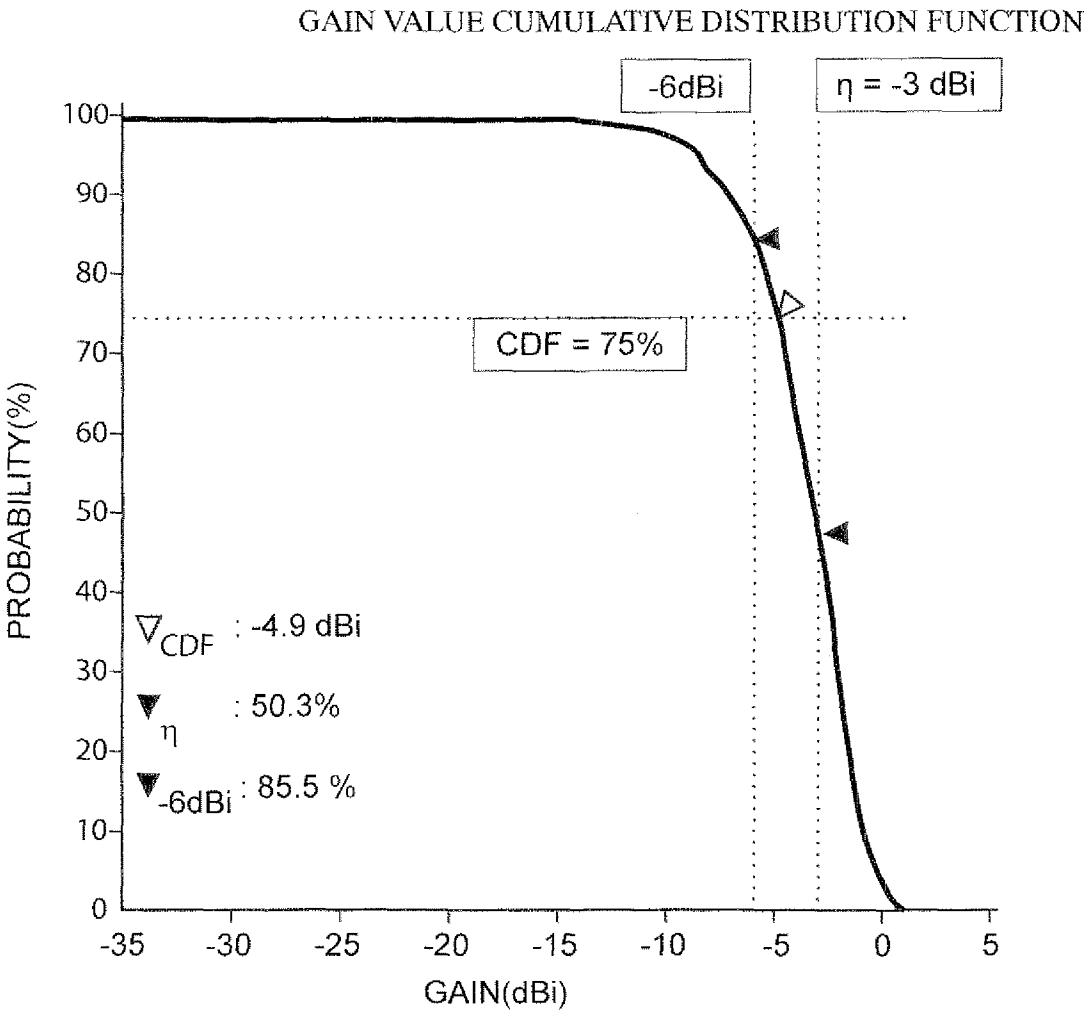
FIG. 7 is a plot illustrating the cumulative distribution of gain of the multi-band antenna of the first preferred embodiment operating at 2600 MHz.

Shown in FIGS. 6 and 7 are plots of cumulative distribution function (CDF, in percentage) of gain values (in decibel isotropic, dBi) of the conventional antenna 9 of the prior art and that of the multi-band antenna 100 of the first preferred embodiment of the present invention, respectively, operating at 2600 MHz. Accordingly, at a gain value of −6 dBi, the multi-band antenna 100 of the first preferred embodiment and the conventional antenna 9 of the prior art are at 85.5% and 78.5%, respectively. Furthermore, at a gain value of 1 dBi, the multi-band antenna 100 of the first preferred embodiment and the conventional antenna 9 of the prior art are at 0% and 1%, respectively. Therefore, the multi-band antenna 100 of the first preferred embodiment of the present invention has peak gain suppression and a relatively high radiation efficiency.

Figure 8:
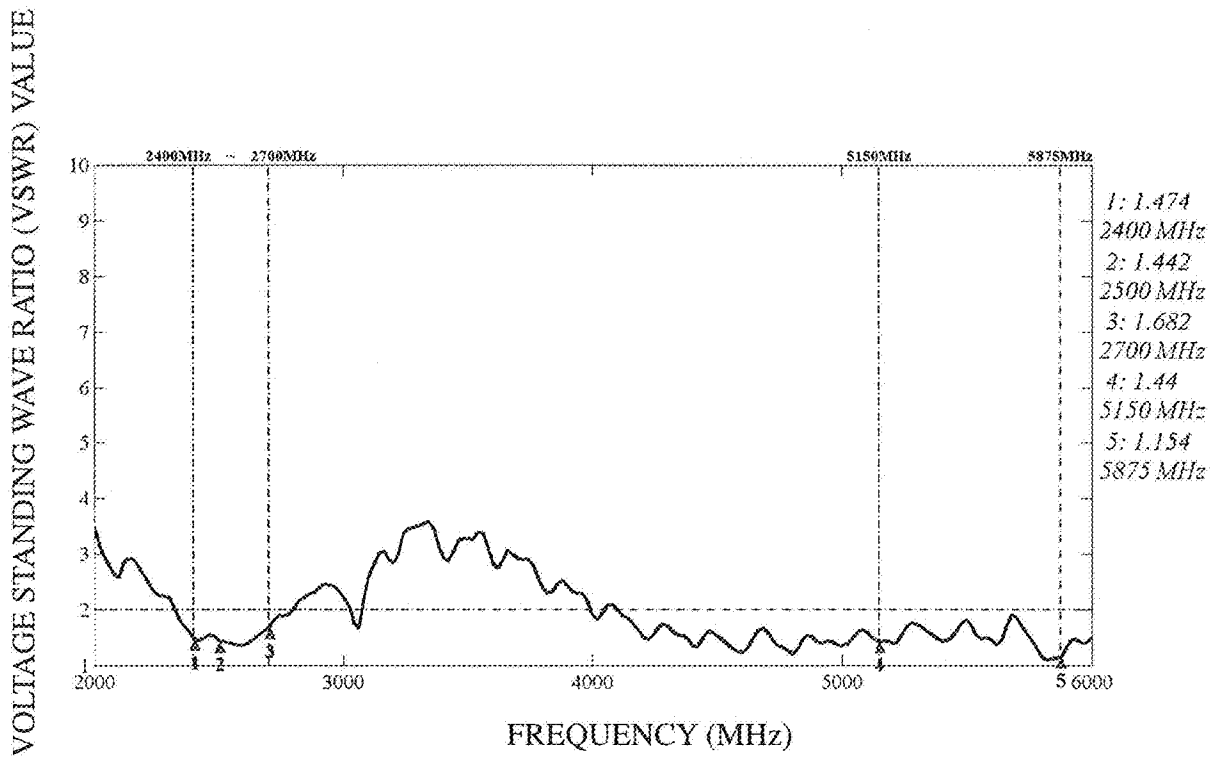
FIG. 8 is a diagram illustrating the Voltage Standing Wave Ratio (VSWR) plot of the multi-band antenna of the first preferred embodiment.

Referring to FIG. 8, the Voltage Standing Wave Ratio (VSWR) plot of the multi-band antenna 100 of the first preferred embodiment shows that the multi-band antenna 100 has measured VSWR values lower than 2 at frequencies ranging from 2400 MHz to 2700 MHz, and from 5150 MHz to 5875 MHz.

Moreover, referring to Table 1, the multi-band antenna 100 has gain values ranging from −2.3 dBi to −4.3 dBi in the frequency bands of Wireless Local Area Networks (WLAN) and Worldwide Operability for Microwave Access (WIMAX) networks.

TABLE 1

| Frequency Band | Frequency (MHz) | Gain value | Peak_H | Peak_V |
|---|---|---|---|---|
| WLAN 2.4 GHz | 2400 | −2.9 | −1.9 | −0.3 |
| | 2442 | −2.6 | −1.5 | −2.5 |
| | 2484 | −2.3 | −0.9 | −1.5 |
| WIMAX 2.5 GHz | 2500 | −2.3 | 0.7 | −1.1 |
| | 2525 | −2.5 | 1.1 | −1.4 |
| | 2550 | −2.8 | 0.7 | −1.2 |
| | 2575 | −2.9 | −0.9 | −1.8 |
| | 2600 | 3.0 | 0.4 | −1.2 |
| | 2625 | −3.1 | 1.3 | −0.7 |
| | 2650 | −3.0 | 1.4 | −1.6 |
| | 2675 | −3.1 | 0.8 | −0.8 |
| | 2700 | −2.9 | 1.0 | −0.9 |
| WLAN 5 GHz | 5150 | −3.1 | −3.2 | −0.3 |
| | 5350 | −3.0 | −4.1 | −1.6 |
| | 5470 | −3.6 | −3.4 | −1.9 |
| | 5725 | −4.3 | −4.4 | −3.5 |
| | 5875 | −3.6 | −3.2 | −2.4 |

Figure 9:
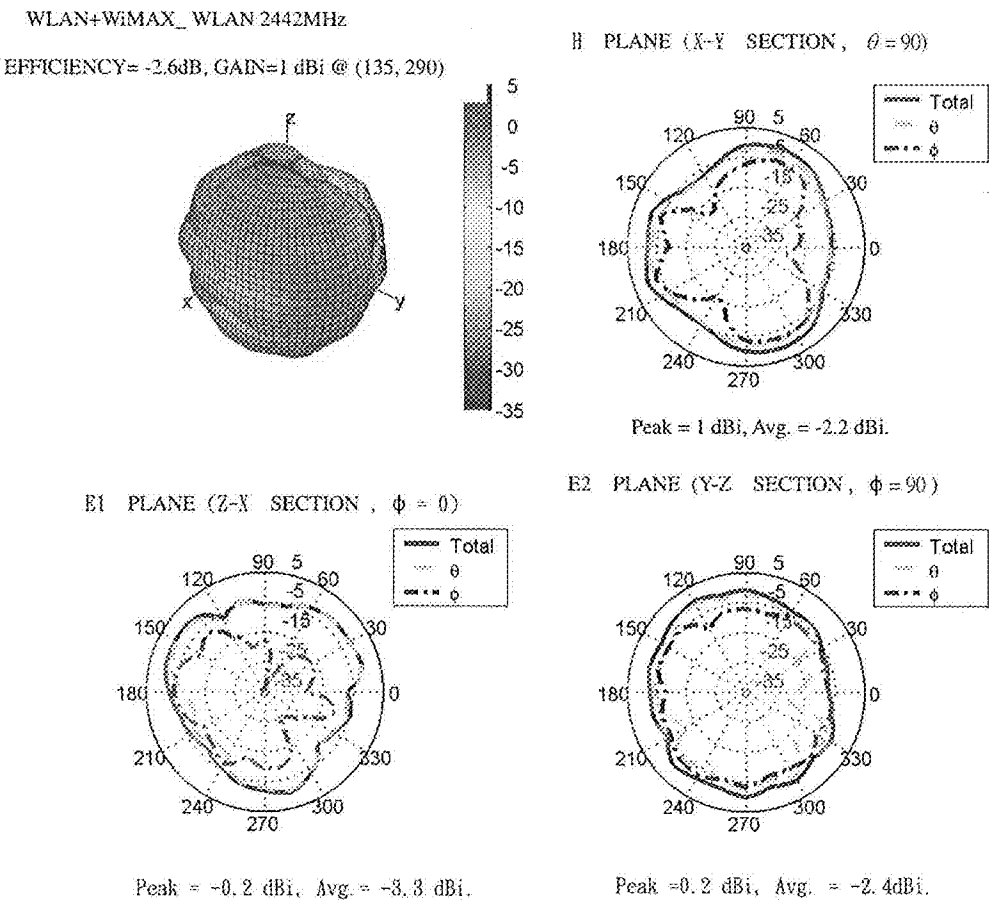
FIGS. 9 to 11 are radiation pattern diagrams of the multi-band antenna of the first preferred embodiment operating at 2442 MHz, 2600 MHz, and 5470 MHz, respectively, the radiation patterns of the multi-band antenna of the first preferred embodiment at each of the frequencies being viewed on the X-Y, Z-X, and Y-Z planes.
Figure 10:
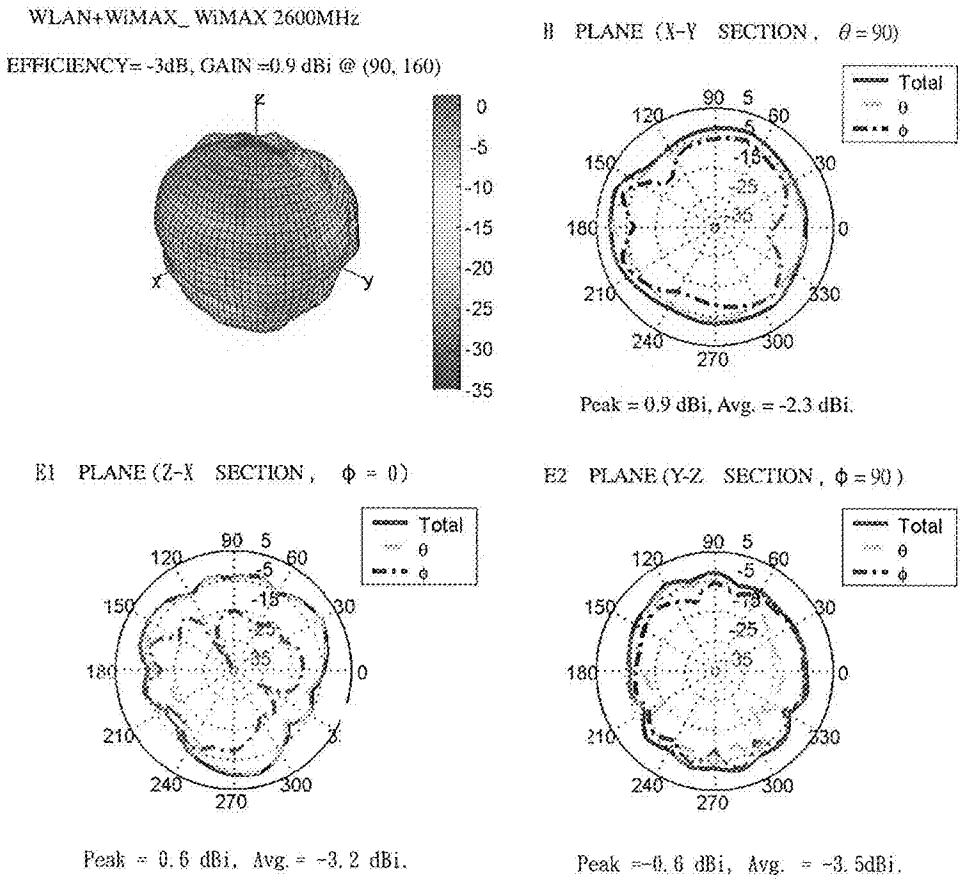
Figure 11:
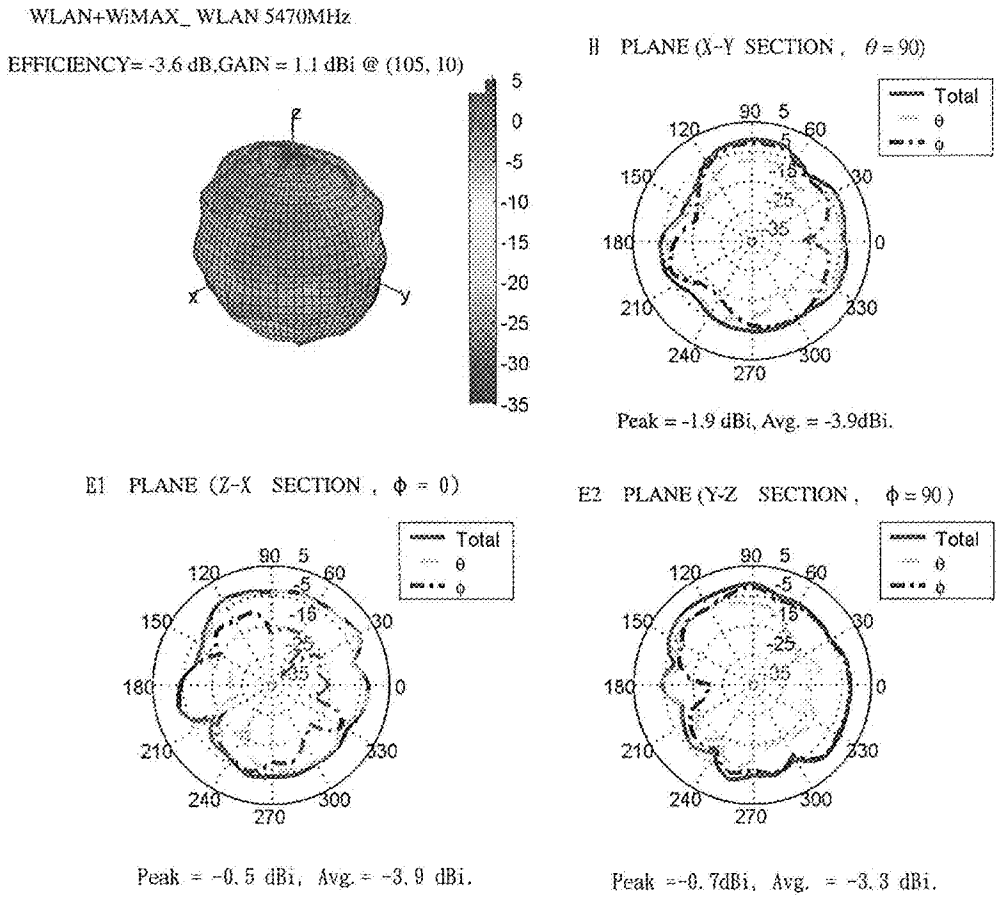

FIGS. 9 to 11 show radiation patterns of the multi-band antenna 100 at frequencies of 2442 MHz, 2600 MHz, and 5470 MHz, respectively. Electrical fields and magnetic fields of the radiation patterns are presented on the X-Y, Z-X, and Y-Z planes. In each of the plane diagrams of the radiation patterns, the lighter dashed-line represents the electric field (theta), the darker dashed-line represents the magnetic field (phi), and the solid line represents the total of the electrical field and magnetic field. It can be noted from FIGS. 9 to 11 that radiation patterns of the multi-band antenna 100 are substantially omni-directional.

In summary, the multi-band antennas 100, 500, 600, 700 of the preferred embodiments of the present invention have peak gain suppression and relatively high radiation efficiencies, and are applicable to WLAN and WIMAX networks.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. An antenna adapted for disposing on a substrate, said antenna comprising:

a grounding element;

a connecting element including an elongated first connecting section, and a second connecting section connecting said first connecting section to said grounding element;

a first radiator element including a first radiator section extending substantially perpendicular from one side of said first connecting section, and second and third radiator sections extending substantially perpendicular from one side of said first radiator section; and a second radiator element including a first radiator portion extending substantially perpendicular from said one side of said first connecting section, and second and third radiator portions extending substantially perpendicular from one side of said first radiator portion and extending in an opposite direction relative to said second and third radiator sections, wherein said first connecting section has one end distal from said second connecting section and serving as a feed-in point for feeding of signals.

2. The antenna as claimed in claim 1, wherein said grounding element is elongated and said second connecting section extends substantially perpendicular from one end of said grounding element.

3. The antenna as claimed in claim 2, wherein said first connecting section extends substantially parallel to said grounding element.

4. The antenna as claimed claim 3, wherein said grounding element has opposite first and second ends, said second connecting section extends from said first end of said grounding element, and said first connecting section extends from said second connecting section in a direction from said first end to said second end of said grounding element.

5. The antenna as claimed in claim 1, wherein said third radiator section and said third radiator portion are disposed proximate to said first connecting section relative to said second radiator section and said second radiator portion, respectively.

6. The antenna as claimed in claim 5, wherein said first radiator section and said first radiator portion have respective distal ends distal from said first connecting section, and said second radiator section and said second radiator portion extend from said distal ends of said first radiator section and said first radiator portion, respectively.

7. The antenna as claimed in claim 1, wherein:

said first radiator element further includes a fourth radiator section extending substantially perpendicular from said one side of said first radiator section; and said second radiator element further includes a fourth radiator portion extending substantially perpendicular from said one side of said first radiator portion and extending in the opposite direction relative to said second and third radiator sections.

8. The antenna as claimed in claim 1, wherein said first and second radiator elements are resonant in first and second frequency bands, respectively.

9. An antenna device comprising:

a substrate; and an antenna disposed on said substrate and including a grounding element, a connecting element including an elongated first connecting section, and a second connecting section connecting said first connecting section to said grounding element, a first radiator element including a first radiator section extending substantially perpendicular from one side of said first connecting section, and second and third radiator sections extending substantially perpendicular from one side of said first radiator section, and a second radiator element including a first radiator portion extending substantially perpendicular from said one side of said first connecting section, and second and third radiator portions extending substantially perpendicular from one side of said first radiator portion and extending in an opposite direction relative to said second and third radiator sections, wherein said first connecting section has one end distal from said second connecting section and serving as a feed-in point for feeding of signals.

10. The antenna device as claimed in claim 9, wherein said grounding element is elongated and said second connecting section extends substantially perpendicular from one end of said grounding element.

11. The antenna device as claimed in claim 10, wherein said first connecting section extends substantially parallel to said grounding element.

12. The antenna device as claimed in claim 11, wherein said grounding element has opposite first and second ends, said second connecting section extends from said first end of said grounding element, and said first connecting section extends from said second connecting section in a direction from said first end to said second end of said grounding element.

13. The antenna device as claimed in claim 9, wherein said third radiator section and said third radiator portion are disposed proximate to said first connecting section relative to said second radiator section and said second radiator portion, respectively.

14. The antenna device as claimed in claim 13, wherein said first radiator section and said first radiator portion have respective distal ends distal from said first connecting section, and said second radiator section and said second radiator portion extend from said distal ends of said first radiator section and said first radiator portion, respectively.

15. The antenna device as claimed in claim 9, wherein:

said first radiator element further includes a fourth radiator section extending substantially perpendicular from said one side of said first radiator section; and said second radiator element further includes a fourth radiator portion extending substantially perpendicular from said one side of said first radiator portion and extending in the opposite direction relative to said second and third radiator sections.

16. The antenna device as claimed in claim 9, wherein said first and second radiator elements are resonant in first and second frequency bands, respectively.

17. The antenna device as claimed in claim 9, wherein said first, second and third radiator sections and said first, second and third radiator portions are disposed on a same surface of said substrate.

18. The antenna device as claimed in claim 9, wherein said substrate has opposite first and second surfaces, said first and second radiator sections and said first and second radiator portions are disposed on said first surface of said substrate, said third radiator section and said third radiator portion are disposed on said second surface of said substrate and are connected electrically and respectively to said first radiator section and said first radiator portion via respective via holes.

* * * * *